US005640655A

United States Patent [19]

Shoji

[11] Patent Number: 5,640,655

[45] Date of Patent: Jun. 17, 1997

[54] CARRIER LIQUID REMOVING APPARATUS AND IMAGE REPRODUCING APPARATUS USING THE SAME

[75] Inventor: Yoshio Shoji, Ebina, Japan

[73] Assignee: Fuji Xerox Co., Ltd., Tokyo, Japan

[21] Appl. No.: 631,094

[22] Filed: Apr. 12, 1996

[30] Foreign Application Priority Data

Apr. 28, 1995 [JP] Japan ..... 7-105858
Jan. 31, 1996 [JP] Japan ..... 8-015740

[51] Int. Cl.[6] ..... G03G 15/10

[52] U.S. Cl. ..... 399/249; 15/256.52; 492/35

[58] Field of Search ..... 355/256, 296, 355/307; 118/652, 659, 661; 15/256.51, 256.52; 101/425; 430/117, 125; 492/17, 35

[56] References Cited

U.S. PATENT DOCUMENTS

| | | | |
|---|---|---|---|
| 3,757,398 | 9/1973 | Urban | 492/7 |
| 3,785,286 | 1/1974 | Giori | 101/425 |
| 4,286,039 | 8/1981 | Landa et al. | 430/119 |
| 4,299,902 | 11/1981 | Soma et al. | 430/125 |
| 4,392,742 | 7/1983 | Landa | 355/296 |
| 4,546,698 | 10/1985 | Bouvet | 492/35 X |
| 4,607,947 | 8/1986 | Ensing et al. | 355/283 |
| 4,878,090 | 10/1989 | Lunde | 118/652 |
| 4,879,197 | 11/1989 | Kohmura et al. | 430/119 |
| 5,023,665 | 6/1991 | Gundlach | 355/256 |
| 5,064,738 | 11/1991 | Rakov et al. | 430/117 |
| 5,120,630 | 6/1992 | Wadlo et al. | 430/103 |
| 5,296,645 | 3/1994 | Zwadlo et al. | 118/647 |
| 5,332,642 | 7/1994 | Simms et al. | 430/125 |
| 5,424,813 | 6/1995 | Schlueter, Jr. et al. | 355/256 |
| 5,552,869 | 9/1996 | Schilli et al. | 355/256 |

FOREIGN PATENT DOCUMENTS

| | | |
|---|---|---|
| 50-45645 | 4/1975 | Japan . |
| 50-99551 | 8/1975 | Japan . |
| 3-80274 | 4/1991 | Japan . |
| 3-145680 | 6/1991 | Japan . |

*Primary Examiner*—Arthur T. Grimley
*Assistant Examiner*—Sophia S. Chen
*Attorney, Agent, or Firm*—Oliff & Berridge

[57] ABSTRACT

A liquid removing device for removing carrier liquid from an image carrying member on which a toner image containing toner particles is formed. The liquid removing device is useful for image reproducing apparatus such as a color image copier. The liquid removing device comprises a base member, an elastic perforated material formed on the base member and having a continuous porosity sufficient to absorb excess liquid therein and an outermost layer formed on the elastic perforated material which has low surface energy sufficient to prevent an offset phenomenon of the toner image and small apertures defined thereby allowing passage the carrier liquid but the toner image therethrough.

20 Claims, 9 Drawing Sheets

CARRIER LIQUID REMOVING APPARATUS AND IMAGE REPRODUCING APPARATUS USING THE SAME

BACKGROUND OF THE INVENTION

The present invention relates generally to a device for removing excess carrier liquid on an image carrying member of image reproducing apparatus, and more particularly concerns a device for removing excess carrier liquid by using a specific carrier liquid removing roller member or belt member coupled to additional squeezing roller or vacuum source.

As a developing method for the latent images formed on the photoconductive drum, both dry developing methods and liquid developing methods have been used.

The liquid carrier used in the liquid developing method enables a fine dispersion of toner particles therein. Therefore, the liquid developing method is suitable for color image development requiring high-resolution images. Also, liquid development is suitable for color reproducing methods such as the image-on-image developing process, in which different color toner images are formed continuously on a photoconductive drum, because the scavengeless characteristic of liquid development compare to the dry developing process. However, when liquid developer is used, carrier liquid remains on the surface of a photoconductive member with toner particles. While the carrier liquid is necessary to transfer toner particles onto the surface of the photoconductive drum, excess carrier liquid remaining on the surface of the photoconductive member should be removed before the following transfer process, because the remaining carrier liquid contributes to a low transfer phenomenon of the toner particles to the copy paper and low fusing efficiency of the toner image on the copy paper. Also, excess liquid developer should be removed in order to prevent the discharge of vaporized liquid carrier to the outside environment of the machine. To remove the excess carrier liquid from the surface of the photoconductive member, various kind of excess carrier liquid removing devices have been utilized.

U.S. Pat. No. 4,286,039 discloses an image forming apparatus comprising a deformable polyurethane roller, which may be a squeezing roller or blotting roller, biased by a potential having a polarity the same as the polarity of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 4,299,902 discloses an image forming apparatus comprising an elastic roller which squeezes out and absorbs excess liquid developer. The elastic roller is comprised of a central roller, a porous elastic member wrapped around the roller, and an outermost elastic member with a plurality of penetrating pores. As the outermost elastic member, a net member having 100–300 mesh composed of a textile of monofilament fibers of polyamide, polyester, polypropylene, polyether, vinylon are disclosed.

U.S. Pat. No. 4,392,742 discloses a cleaning system for a liquid developer electrophotographic copier comprising a roller formed with a resilient material, such as a closed-cell elastomer, having externally exposed, internally isolated surface cells. During operation, the excess liquid on an imaging surface is absorbed by the cleaning roller. The cleaning roller is then compressed to squeeze out liquid from the roller, leaving the roller dry.

U.S. Pat. No. 4,878,090 discloses a development apparatus comprising a vacuum source which draws air around a shroud to remove excess liquid carrier from the development zone.

U.S. Pat. No. 4,879,197 discloses a pair of squeeze rollers for an electrophotographic machine comprising a metal roll with an elastomeric roller wrapped around the metal. The squeeze rollers remove excess developer from the photoreceptor.

U.S. Pat. No. 3,757,398 discloses a squeezing roller comprised of a thin layer of synthetic material with squeezes liquid from textile webs. As the synthetic material, polyurethane foam is disclosed.

U.S. Pat. No. 5,023,665 discloses an excess liquid carrier removal apparatus for an electrophotographic machine. The apparatus is comprised of an electrically biased electrode having a slit therein coupled to vacuum pump. The vacuum pump removes, through the slit in the electrode, liquid carrier from the space between the electrode and the photoconductive member. The electrical bias generates an electrical field so that the toner particle image remains undisturbed as the vacuum withdraws air and liquid carrier from the gap.

U.S. Pat. No. 4,607,947 discloses a circulating cleaning member comprising a multiplicity of spaced-apart openings or perforations. A surface of the cleaning member collects residues of toner from a surface to be cleaned.

U.S. Pat. No. 5,332,642 discloses a vacuum assisted dispersant reduction system. The system includes a vacuum pump and a biased roller coupled to a bias source which has same polarity with the toner charge. The biased roller includes a carrier liquid absorption material including polytetrafluoroethylene foam member. The patent also disclose capillary action to absorb the carrier liquid and the best surface characteristic of a surface layer as hydrophobic characteristic due to "surface tension".

JP-A 50-45645 discloses a carrier liquid squeezing system comprising a first squeezing roller contacted to a photoreceptor and second squeezing roller pressingly contacted to the first squeezing roller so as to squeeze the carrier liquid from the first squeezing roller. For the squeezing roller, sponge like materials such as polyurethane foam are disclosed.

JP-A 3-80274 discloses a carrier liquid squeezing system which is comprised of cylindrical foam roller and an uniform fine particle layer formed on the foam roller. The carrier liquid is removed by vacuum force generated by vacuum source coupled to a hollow portion of the cylindrical foam roller.

JP-A 3-145680 discloses a carrier liquid squeezing system which is comprised of rotatable hollow sponge roller, vacuum source coupled to a hollow portion of the cylindrical foam roller and cover member to cover a surface of the sponge roller portionally to enhance the vacuum force.

However, these carrier liquid removing devices unintentionally remove the toner particles partially with the excess carrier liquid therefrom. The lack of uniformity of toner -image concentration causes unacceptable or severe image defects in resulting toner image, especially in pictorial color image produced by color image reproducing techniques. In addition, the contacting-type excess liquid carrier removing device is sometimes deformed by mechanical or chemical stress during the image forming process. The deformed surface of the roller also results in a partial offset phenomenon sufficient to produce unacceptable or severely degraded image quality.

The offset toner particles on the surface of the carrier liquid removing roller cause reattachment of the toner particles to the surface of the photoconductive member, which also results in further image defects. Otherwise, the offset toner particles are drawn into apertures or openings of the absorbing roller and accumulated therein, causing a declining of vacuum power.

The references cited herein are incorporated by reference for their teachings.

SUMMARY OF THE INVENTION

The present invention provides a liquid removing device for removing carrier liquid from an image carrying member on which a toner image containing toner particles is formed, which comprises a base member, an elastic perforated material formed on the base member having a continuous porosity sufficient to absorb the excess liquid on the image carrying member and an outermost layer formed on the elastic perforated material having a) a low surface energy sufficient to prevent offset of the toner image, and b) small apertures allowing carrier liquid substantially permeate the carrier liquid but the toner image.

The present invention also provides an image reproducing apparatus having the specific liquid removing device.

DESCRIPTION OF THE PREFERRED EMBODIMENT

Figure 2A:
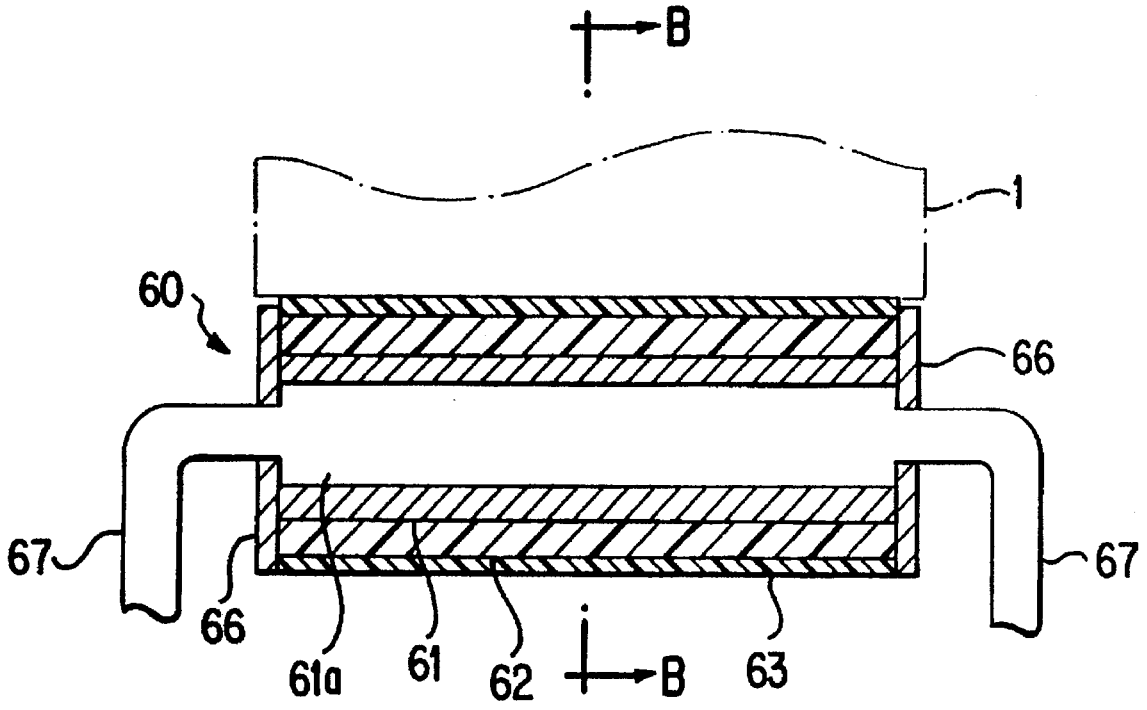
FIG. 2(*a*) is a cross-sectional view of the liquid carrier removing device of present invention and FIG. 2(*b*) is a cross-sectional side view of embodiment of FIG.(*a*) taken along lines B—B of FIG.(*a*)

With reference now to the drawings, which illustrate a preferred embodiment of the invention and do not limit same, as indicated in FIG. 2(*a*) and FIG. 2(*b*), a carrier liquid removing device 60 of present invention includes a base member 61, an elastic perforated material 62 formed on base member 61 and an outermost layer 63 which is a perforated material formed on elastic perforated layer 62. The carrier liquid removing device contacts the surface of image carrying member 1 to remove excess carrier liquid on the surface of the image carrying member.

Outermost layer 63 has a low surface energy sufficient to prevent offset of the toner image. Layer 63 also includes small apertures which allows carrier liquid remaining on the image carrying member to penetrate layer 63 to layer 62, but prevents toner from penetrating layer 63. To avoid the offset phenomenon, preferably the outermost layer has sufficient low surface energy with respect to the toner material to be used. Common values include not more than 25 $mJ/m^2$ and preferably from 6 $mJ/m^2$ to 25 $mJ/m^2$ surface energy. To allow penetration of the carrier liquid, but not toner through the perforated outermost layer, the average diameter of the apertures is preferably not more than an average particle diameter of toner particles. However, due to the existing attractive force between the toner particles and the surface of the image carrying member, the average diameter of the apertures may be much larger than that of toner particles. Furthermore, if an anti-transfer electric field, an electric field to attract toner particles on the surface of the image carrying member, is additionally applied, the average diameter of the apertures may be still much larger than that of toner particles. As the toner particles generally have an average particle diameter from 0.1 to 20 μm, suitable average diameter of the apertures of the outermost layer 63 is generally, less than 20 μm, preferably 0.05 to 10 μm, most preferably 0.1 to 7 μm respectively. By preventing toner offset to the outermost layer 63, intruding and accumulating of the toner particles in the elastic perforated material 62 is avoided. Further, image defects due to the offset toner particles on the outermost surface 63 is avoided. The outermost layer 63 generally has a thickness from 1 to 10 μm, preferably from 1 to 5 μm and porosity of from 10 to 50 percent.

As suitable materials for the outermost layer 63 are fluorinated compounds or fluoroelastomer include polytetrafluoroethylene (PTFE) (Surface energy, indicates as SE hereinafter,: 18.5 $mJ/m^2$), tetrafluoroethylene perfluorovinylether copolymer (PFA) (SE: 20 $mJ/m^2$), tetrafluoroethylene-hexafluoropropylene copolymer (FEP) (SE:19 $mJ/m^2$), polyvinylidenefluoride (PVDF) (SE:25 $mJ/m^2$). Fluorine rubber coated with partially amino-modified dimethylpolysiloxane (silicone oil ) (SE:24 $mJ/m^2$) is also preferably used. Silicone resin or silicone rubber generally have a tendency to swell on contact with liquid developer.

The surface energy of the outermost layer 63 may be reduced by introducing fluorinated graphite. Because the fluorinated graphite compound has a surface energy about 6.0 $mJ/m^2$, the surface energy of the outermost layer 63 of present invention could be reduced up to 6 $mJ/m^2$.

The surface energy of any material is estimated by the Zismann-plot method, which determines the surface energy of specific material by the relationship between a contact angle of a various kind of liquids located on the surface of the specific material and the surface tension of these liquids. Surface energy is determined by the steps comprising measuring contact angles of various kind of liquids, each of which has peculiar critical surface tension, located on the surface of the objective material, plotting the relationship between the surface tension, as the horizontal axis, and the contact angle ($\theta$) or cosine of the contact angle ($\cos\theta$), as the vertical axis, to obtain a straight line and obtaining the value of the surface energy of the object material which is the surface energy when the contact angle is 0 (zero) and is obtained by extrapolating the straight line. The liquids used to determine the contact angle include n-hexane, octane, tetradecane, water, glycol-solution dichloromethane or the like.

The outermost layer 63 can be formed on the elastic perforated material 62 by various methods, such as, for example, electro-plating methods, electroless-plating method, spray coating methods or the like. If these plating methods are used, the outermost layer indicates superior water repellant properties because raw material grains having low surface energy will be extracted to the outermost portion of the outermost layer 63 during the plating process. Otherwise, in the case of roller type device, the outermost layer may be formed by seamless film tube having many pores thereon. The seamless tube is firstly covered on the elastic perforated material layer 62 and finally shrunk onto the tube by heat energy.

Outermost layer 63 is preferably formed as an seamless layer. The outermost layer may be made by seamed process of a film such as membrane, however the seamed portion sometimes generates nonuniform contact pressure to the image carrying member.

For the elastic perforated layer 62, foam materials having a continuous foam shape comprising small apertures clustered together are preferably used. The foam materials can be composed of any material capable of absorbing carrier liquid and provided with a suitable elasticity, for example, a plastic foam composed of polystylene, polyethylene, polyurethane, polyvinyl chloride, nitrile-butylene rubber or the like. Preferably, the foam material is made from polyurethane foam having many apertures as small as possible. The foam materials may be conductive. As the conductive foam material, meltout-type polyurethane foam made by wet-process is preferably used because the meltout-type polyurethane foam has higher absorbing ability, smaller apertures and highly conjugated-foam structure.

The elastic perforated layer has aperture diameter generally ranging from 3 to 50 μm, preferably from 3 to 30 μm. Preferable porosity ranges from 50 to 80 percent. If the elastic perforated material is formed as a layer for a roller configuration, the absorbing layer preferably has from 50 μm to 5 mm thickness, and from 10 to 50 degree rubber hardness. If the elastic perforated material is formed as a layer for a belt configuration, the absorbing layer preferably has from 1 to 30 μm thickness, more preferably from 2 to 10 μm thickness and has generally from 15 to 70 degree Asker hardness, preferably 30 to 60 Asker hardness. If a conductive elastic perforated material is used, volume resistivity is, in generally, in the range of not more than $10^{10}$ Ωcm and preferably from $10^6$ to $10^9$ Ωcm.

Figure 2B:
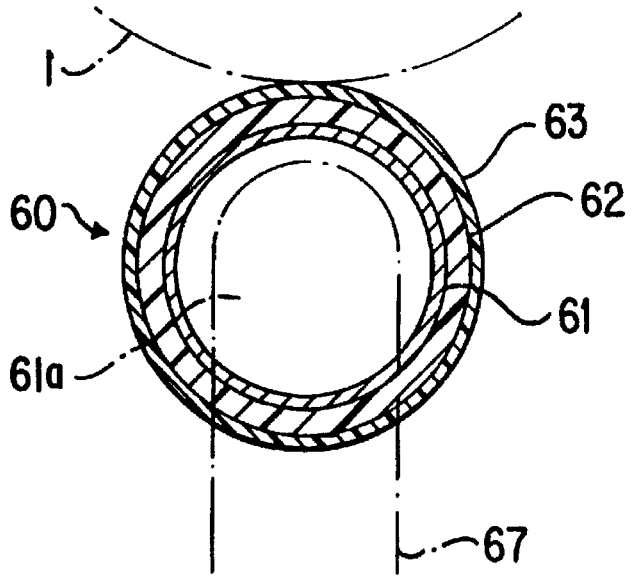
Figure 3:
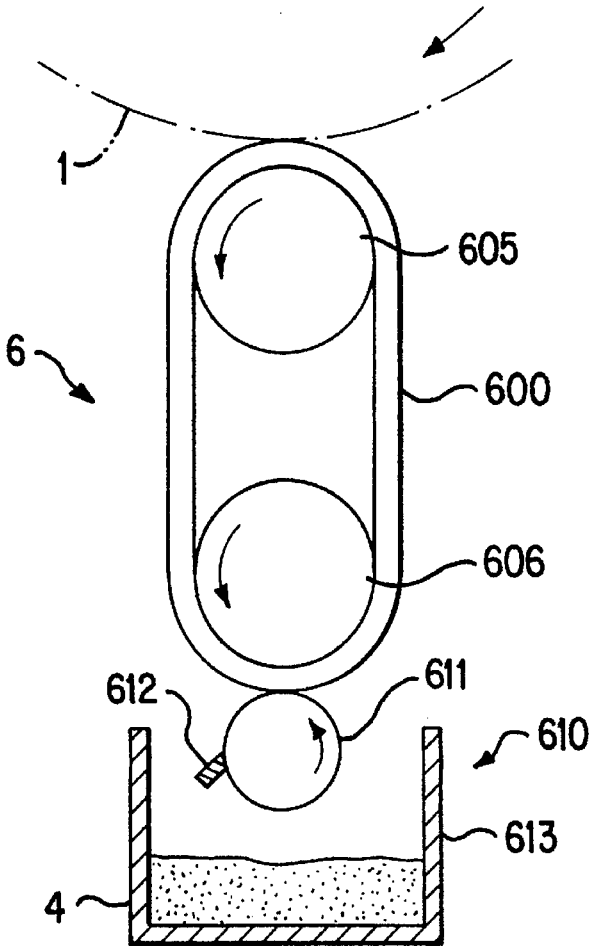
FIG. 3 is a schematic representation of another embodiment of carrier liquid removing apparatus of present invention.
Figure 4:
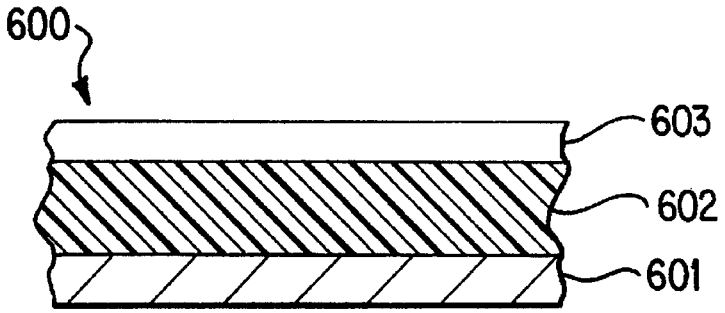
FIG. 4 is a cross-sectional view of the carrier liquid removing member of another embodiment of present invention.

As the base member 61 of the liquid absorbing member, both roll-shape members as in FIG. 2*b* or belt-shape member as indicated in FIG.3 can be used. The base member preferably has high chemical resistivity against to the liquid carrier, appropriate mechanical strength. Base member 61 may be made from conductive or non-conductive material. If conductive material is used, the metal material should generally not have more than $10^2$ Ωcm volume resistivity. These materials typically include stainless steel, brass, nickel and nickel-chrome alloy. These metal materials may have many apertures, and may include mesh structures or other kind of aperture structures formed by sintering of metal material, or mechanical punching or the like. The base member may be made from perforated or mesh metal sheet. For example, if perforated metal sheet material made by metal sintering or mechanical punching is used, the sheet is initially rolled several times and formed as a hollow cylindrical shape. Then, a seam-portion of the rolled sheet material is welded, for example, by an algon welding method. If a mesh sheet is used, the mesh sheet is rolled for several times and compressed to form a hollow cylindrical shape. In this case, the seam portion of rolled mesh sheet is bonded to itself by pressure. In such a manner, nonuniformity of liquid absorption due to seam portion of the base material is effectively avoided. Nickel-Chrome alloy is preferably because of its strength. Other sheet-type materials such as plastic materials for example polyethylenetelephtalate (PET), polyethylene (PE), polyvinylidenefluoride (PVDF) may be also used as the base member. These sheet materials may be formed into a belt shape. If the sheet materials are formed into belt shapes, the belt may be formed as an endless belt or an ended belt having two end portions which are winded up at the appropriate portion. The thickness of sheet material formed into the base member is generally in the range from 25 to 400 μm, preferably in the range from 50 to 150 μm.

If the base member 61 is a perforated member, then the base member 61, the elastic perforated material 62 and an outermost layer 63 each have carrier liquid apertures therein respectively. The average diameters of these apertures are preferably decreased in this order. In other words, the outermost layer 63 has the smallest aperture diameter. This configuration ensures the prevention of toner intrusion to the elastic perforated material 62. In addition, the smallest apertures of outermost layer 63 enhance capillary force generated thereon sufficient to absorb the carrier liquid. If the outermost layer is configured so that the layer is relatively thin, with sufficiently small apertures, the outermost layer 63 enhances not only absorbing capacity but also the vacuum efficiency, by preventing the toner intrusion therein. This feature is also effective to reduce the remaining excess carrier liquid in the pores of the elastic perforated material 62. By suitable configuration of the outermost layer, the capillary force might be larger than the vacuum force applied to the carrier liquid removing device 60.

Outermost layer 63 also enhances cleanability due to the existence of small apertures as well as the lower surface energy. In addition, the outermost layer 63 enhances resistance to deformation of the carrier liquid removing device, especially at the edge portions of the device. Deformation of the carrier liquid removing device 60 may affects the image quality, because the device is configured so as to contact or face the toner image on the image carrying member directly. Deformation of the carrier liquid removing device generates a nonuniform pressure on the image carrying member.

Figure 1:
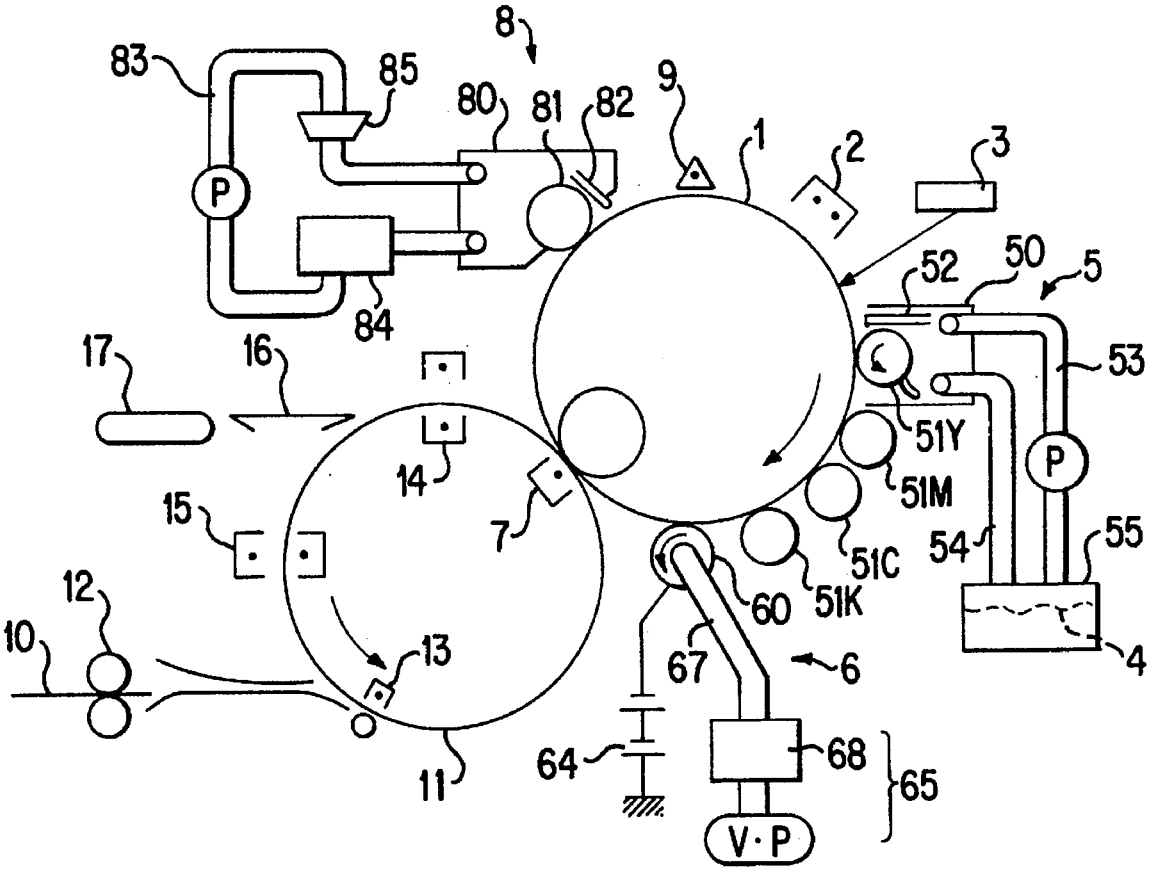
FIG. 1 is a schematic representation of the image reproducing apparatus of present invention.

As indicated in FIG. 1, vacuum-type liquid removing means 65 for applying a negative pressure in the hollow portion 61*a* of the carrier liquid removing device may be installed. Otherwise, as indicated in FIG. 3*a* contact-type liquid squeezing member 611 for contacting to the carrier liquid member and squeezing the excess carrier liquid therefrom is used independently of or in combination with a vacuum type liquid removing means.

Air tight seal members may be provided against an appropriate portion of the outermost layer 63 in order to enhance vacuum efficiency. For example an air tight film cover may be installed over the carrier liquid removing apparatus except for the nip portion.

Preferably, at least one of the outermost layer 63, the elastic perforated material 62 or the base member 61 is formed as a electrically conductive.

As indicated in FIG. 1, the excess liquid carrier removing device 6 is mounted in contact with or adjacent to the image carrying member, such as photoconductive drum 1. When the device is installed so as not to contact to the surface of photoconductive drum 1, clearance between the surface of the photoconductive drum and the surface of the liquid removing device is preferably set from 20 to 50 μm.

The liquid removing device may be coupled to a bias voltage source which apply the same polarity voltage as the polarity of toner particles. The bias voltage source may be electrically coupled to at least one of the outermost layer 63, the elastic perforated material layer 62 or the base member 61. Otherwise, other conductive layer coupled to the bias voltage source may be formed at an appropriate position of the liquid removing device. The magnitude of the applied voltage is preferably in the range from 100 V to 5000 V, more preferably in the range from 1 KV to 3 KV.

Figure 6:
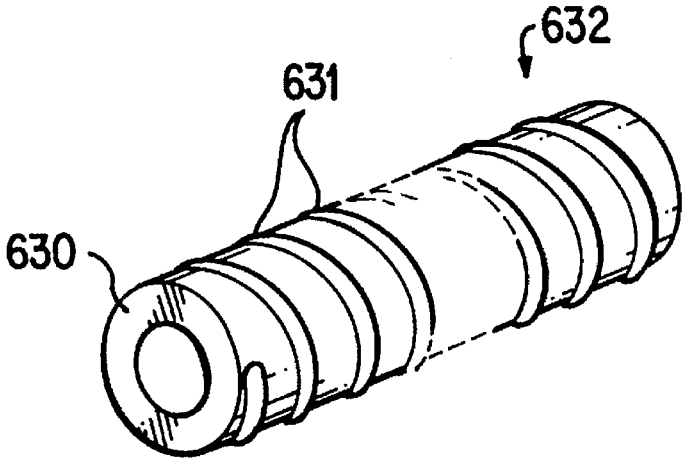
FIG. 6 is a schematic representation of one embodiment of carrier squeezing roller of present invention.
Figure 7:
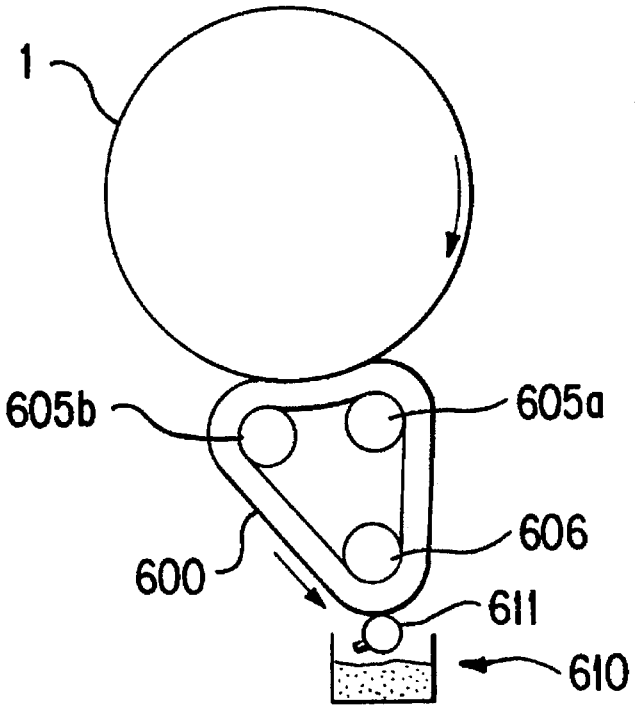
FIG. 7 is a schematic representation of another embodiment of liquid carrier removing apparatus of present invention.
Figure 8:
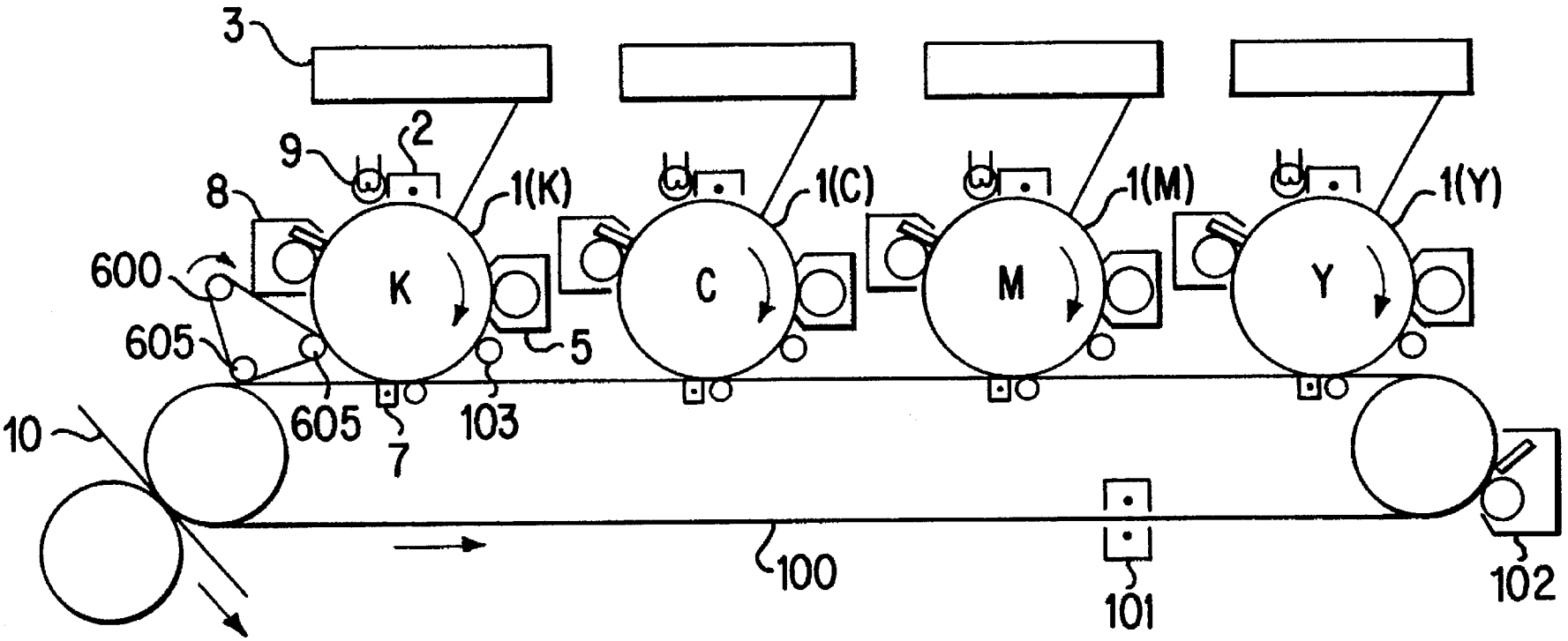
FIG. 8 is a schematic representation of another embodiment of liquid carrier removing apparatus of present invention.

In accordance with another aspect of the invention, a spiral-shaped liquid squeezing roller 632, indicated in FIG. 6, may be used to squeeze and expel excess liquid carrier from the excess liquid carrier removing device. The excess liquid removing device may be configured so that a belt-shape carrier liquid removing device is arranged in contact with the surface of the image forming member over relatively wide area by using dual supporting rollers 605*a* and 605*b*, located beneath the device, in order to enhance liquid absorbing efficiency as indicated in FIG. 7. If an intermediate transfer belt is used in the image forming apparatus, the liquid absorbing member may be mounted to contact both the image forming member and the intermediate belt simultaneously, as indicated in FIG. 8. More detailed feature of the excess liquid carrier removing device of present invention are described in the following example.

EXAMPLE

Example 1

As indicated in FIG. 1, the color copying machine has as main components a photoconductive drum 1 and a charging device 2, an image writing apparatus 3, liquid developing apparatus 5 (Y, M, C, K) including a Yellow developer housing (Y), Magenta developer housing (M), Cyan developer housing (C) and Black developer housing (K) each holding developer liquid 4 respectively, excess liquid developer removing apparatus 6, transfer charging device (Corotron) 7, cleaner 8 and erase lamp 9. Each of them are positioned around the photoconductive drum 1 in the given sequence. A transfer drum 11 is positioned against the surface of the photoconductive drum.

Using the yellow developer housing as an example, where the other housings are constructed similarly, the liquid developer retrieving roller 51Y (and similarly 51M, 51C, 51K for magenta, cyan and black, respectively) and the developing electrode 52 are installed in liquid developing apparatus 5. Developing tank 55 is connected to the main body of the developing apparatus 50 via liquid developer supplying tube 53 and the liquid developer extracting tube 54. A selected voltage is applied to the retrieving roller 51Y and developing electrode 52 of the developing apparatus 5 from a power source (not shown). The cleaner 8 includes main body 80, the rotatable sponge roller 81, cleaning blade 82, retrieving tank 84 connected to the main body 80 via the liquid transporting tube 83, liquid developer filter 85 and a pump indicated by capital character P.

Also, the transfer arrangement includes the charging device 13, attaching the recording paper 10 transported from the paper transporting apparatus 12 to an outer surface of the intermediate transfer drum 11, a pair of the detack corotron 14, detaching the recording paper 10 from the outer surface of the transfer drum 11, and a pair of the erasing corotrons 15, erasing the residual charge on the surface of the transfer drum 11 after the detaching of the paper 11 from the intermediate transfer drum 11. The paper transporting device 16, transporting the paper 10 detached from the transfer drum 11, is installed between the detack corotron 14 and the erasing corotron 15. Fusing apparatus 17 is installed following the paper transporting device 16.

The excess liquid carrier removing roller 60 is one component of the excess liquid developer removing apparatus 6. With reference to FIG. 2(*b*), the liquid absorbing roller 60 might includes cylindrical member 61 having a 2 mm thickness, 300 mm length and 20 mm outer diameter which is made from a perforated metal having many apertures in 100 micrometer diameter, conductive polyurethane foam layer 62 formed on the cylindrical member 61 which is prepared by an wet-process of extruded polyurethane and has 2 mm thickness and about 30 micrometer diameter, and a polytetrafluoroethylene(PTFE) film as an outermost layer 63 of the excess liquid carrier removing roller 60, made by an electroless-plating method, having 10 μm thickness, 108 Ω·cm volume resistivity, 30 degree rubber hardness and about 10 μm porosity. The sleeve member 61 is prepared by winding a perforated metal sheet for three times and forming it to a roller shape by applying pressure. The sleeve member 61 has good dimensional stability, such that a thickness tolerance is ±0.02 mm and roll pitch is ±0.1 mm.

The excess liquid carrier removing roller 60 is rotatably mounted facing the photoconductive drum 1 to ensure about a 3 mm width contact nip along the longitudinal direction of roller 60. A pair of tracking rollers (not shown) may be provided at both end portions of the roller 60. The liquid removing roller 60 is rotated with the rotation of the surface of the photoconductive drum, at approximately the same speed. The entire surface of the liquid removing roller 60 is electrically insulated from the adjacent portions of the machine. The base member 61 of the roller 60 is electrically coupled to the bias voltage source 64 which applies a bias voltage of 1500 Volts of same polarity with that of the toner.

The excess liquid carrier removing device 6 also contains the vacuum source 65 which draws the removed carrier from the conductive polyurethane foam layer 62 by providing negative pressure to the hollow portion 61*a* of the base member 61 of the liquid removing roller 60. The vacuum source 65 includes the vacuum pump VP and the retrieving tank 68. The suction pipes 67 are connected to the hollow portion 61*a* through the side portions of the sleeve member 61 and side plates 66. The excess liquid carrier is retrieved from the sleeve member 61 to the retrieving tank 68 by the vacuum force generated by the vacuum pump VP. In this embodiment, the vacuum pump VP has a vacuum capacity of 30 liters per minute and the vacuum suction pressure of the vacuum pump VP is set to 400 mm Hg, The removing procedure of the excess carrier liquid following each developing step is now described. At first, the liquid absorbing roller 60 is controlled so that the carrier liquid in the pores of the liquid absorbing roller 60 is balanced to the inner pressure of the cylindrical body 61*a* controlling the vacuum source 65. Thus, by vacuuming the absorbed carrier liquid from the inner portion of the cylindrical body 61*a*, the pores are sequentially filled by the removed carrier liquid. The surface portion of the absorbed carrier maintains a meniscus in the pores, which provide a self-sealing function for the liquid developer. In the liquid absorbing roller 60, the amount of the absorbed liquid carrier at the pre-nip portion between the liquid absorbing roller 60 and the photoconductive drum 1 is larger than that of the post-nip portion because the liquid carrier on the surface of the photoconductive drum 1 is accumulated at the pre-nip portion. Thus, the vacuum or removing process of the excess carrier liquid is mainly conducted at the post-nip portion of the excess carrier liquid removing roller 60. The absorbed liquid carrier is retrieved through the suction pipes 67 to the retrieving tank 68.

The following experiment was conducted to evaluate the capability of the liquid carrier removing apparatus 6 by using the aforementioned color printing machine.

The toner concentration values in the liquid developer on the surface of the photoconductive drum are determined both before and after the carrier removing operation by passing a 5 cm×5 cm solid developed toner image, formed on the surface of the photoconductive drum and containing carrier liquid, past the excess carrier liquid removing roller 60. More specifically, the toner concentration before the absorbing operation was calculated by dividing the toner weight by the total developer weight. The toner concentration after the absorbing operation was also calculated by dividing the toner weight by the total developer weight after the removing operation. To determine the weight of toner particles in the liquid developer, the toner image containing the liquid carrier was scraped and collected by a rubber blade and weighed, then heated at 120° C. for about 2 hours to expel the liquid carrier to determine the weight of only toner particles. In this experimentation, a selenium-type photoreceptor was used as a photoconductive drum 1 and the mixture of 2.5 percent of negatively charged toner particles and isoper-L, product name of Exxon Corp., as a carrier liquid, was used as a liquid developer. The surface potential of the image portion was set to +850 volts and the background portion was set to +150 volts. A bias voltage of +50 volts was applied to the developing electrode 52 and a bias voltage of +250 volts was also applied to the carrier retrieving roller 51Y.

In the experiment, toner concentration was changed from 2.5 percent to 37.0 percent by passing the toner image past carrier liquid removing roller 60. It is understood that excess carrier liquid is removed efficiently by liquid carrier removing apparatus 6. Also, offset toner particles were not observed visually on the surface of the liquid absorbing roller 60. As a reference, toner concentration was also determined by the same method using the same machine which had no carrier liquid removing apparatus 6. The toner concentration after development was 15.0 percent. Generally, it is understood that the operation of the liquid developer removing apparatus is satisfactory if toner concentration after the absorbing operation is more than 20.0 percent. The copying process was conducted by using original test pattern. The resulting image on paper had the fine image resolution expected with liquid development, with no image blur. As a reference, in the machine which has no liquid carrier removing apparatus 6, the resulted image on the paper had much excess carrier liquid and some image defects such as image blur. The relationship between the characteristics of the carrier liquid removing apparatus 6 and the evaluation of the resulted images are indicated in Table 1.

Example 2

The same color printing machine to example 1 is used in this example, except that a perforated metal sheet having 150 μm pore size is used for sleeve 61. A perfluoroalkoxy (PFA) resin having 20 mJ/m$^2$ surface energy is used for the surface layer 63 of liquid removing roller 60. Surface layer 63 is formed by a heat contraction process on the perfluoroalkoxy resin film. The film was about 50 μm thickness with apertures formed by punching the film in 500 μm interval with 50 μm diameter needles. Contraction was accomplished by using a drier on the conductive polyurethane foam layer 62. The average diameter of the apertures of the resulting surface layer was estimated to be about 20 μm.

The toner concentration of the toner image formed on the surface of photoconductive drum 1 was estimated after the carrier liquid removing process. The toner concentration was 35.0 percent after the carrier liquid removing process. It is believed that the carrier liquid is selectively and effectively removed from the liquid developer. The offset of the toner particles onto the surface of the outermost layer 63 of carrier liquid removing roller 60 was not observed visually. The copying process was conducted by using original test pattern. The resulting image on paper had the fine image resolution expected with by liquid development with no image blur. The relationship between the characteristics of the carrier liquid removing apparatus 6 and the evaluation of the resulted images are indicated in Table 1.

Example 3

The color copying apparatus of Example 2 was used in this example, except that a polyvinylidenefluoride (PVDF) resin having 25 mJ/ m$^2$ surface energy was used for the surface layer 63 of carrier liquid removing roller 60. The outermost layer 63 was formed by spraying polyvinylidenefluoride (PVDF) liquid and drying at the room temperature on the conductive polyurethane foam layer 62. The average diameter of the apertures of the resulting surface layer was estimated to be about 10 μm. The thickness of the layer was about 15 μm.

The toner concentration of the toner image formed on the surface of photoconductive drum 1 was estimated after the carrier liquid removing process. The toner Concentration was 35.0 percent after the carrier liquid removing process. It is believed that the carrier liquid is selectively and effectively removed from the liquid developer. Some minor offset of the toner particles onto the surface of the outermost layer 63 of liquid absorbing roller 60 was observed visually. However, the offset toner particles could be removed from layer 63 easily. The copying process was conducted by using original test pattern. The resulting image on paper had the fine image resolution expected with liquid development with no image blur. The relationship between the characteristics of the liquid developer removing apparatus 6 and the evaluation of the resulted images are indicated in Table 1.

Comparative Example 1

The same color copying apparatus of Example 2 was used in this comparative example except that a polyethylene (PE) resin having 31 mJ/m$^2$ surface energy was used as the outermost layer 63 of carrier liquid removing roller 60. Surface layer 63 was formed by spraying polyethylene (PE) liquid and drying at the room temperature on the conductive polyurethane foam layer 62. The average diameter of the apertures of the resulting outermost layer was estimated to be about 15 μm. The thickness of the layer was about 25 μm.

The toner concentration of the toner image formed on the surface of photoconductive drum 1 was estimated after the carrier liquid removing process. The toner concentration was 33.0 percent after the carrier liquid removing process. It is believed that the carrier liquid was selectively and effectively removed from the liquid developer. However, an offset of the toner particles to the surface of the outermost layer 63 of carrier liquid removing roller 60 was observed visually and the offset toner particles could not be removed easily. Also, the offset toner particles was transferred to the surface of photoconductive drum again. The relationship between the characteristics of the carrier liquid removing apparatus 6 and the evaluation of the resulted images are indicated in Table 1.

Example 4

FIG. 3 shows yet another embodiment of the present invention. In this embodiment, the carrier liquid removing belt 600 is utilized as the carrier liquid removing device. The carrier liquid removing belt is composed of an endless-belt like Polyethylene telephthalate (PET) film 601 having 150 μm thickness, a polyurethane foam layer 602 formed on the PET film which has many pores of 30 μm size and 2 mm thickness, and been made by wet-process of polyurethane, polytetrafluoroethylene layer formed on the polyurethane foam layer 602, which has 18.5 mJ of surface energy, $10^8$ Ωcm of volume resistivity, 30 degree of rubber hardness, 30 μm size of pores and 10 μm of thickness and has been made by electroless-plating method.

The liquid absorbing belt 600 is extended between a supporting roller 605, which is positioned rotatably against the photoconductive drum 1 keeping a specific clearance therebetween by a tracking roller (not shown), and supporting roller 606, which is positioned to rotatably keep a specific distance from the supporting roller 605. The belt surface 600 is controlled to contact to and rotate to keep an approximately 3 mm nip width for the entire longitudinal direction, with the photoconductive drum 1.

The moving speed of the belt surface is controlled to be substantially the same as that of photoconductive drum 1so that relative speed is zero. No bias voltages applied to liquid absorbing belt 600.

A press-type carrier liquid squeezing roller is used for the excess liquid developer removing apparatus 6 in this embodiment. The press-type carrier liquid squeezing apparatus 610 includes the carrier liquid removing belt 600, squeezing roller 611 rotating to press the carrier liquid removing belt 600 against the supporting roller 606, and scraping blade 612 scraping the excess liquid carrier. The excess liquid carrier is squeezed from the absorbing belt 600 between pressure roller 606 and squeezing roller 611. Numeral 613 indicates retrieving tank.

In this embodiment, excess carrier liquid remaining on the surface of the photoconductive drum is absorbed by the excess carrier liquid removing belt 600. Then excess carrier liquid absorbed in the polyurethane foam layer 602 of the liquid absorbing belt 600 is removed by squeezing apparatus 610 at the nip portion thereof. Finally removed liquid developer is retrieved into the retrieving tank 613.

The excess carrier liquid removing apparatus 6 utilizing the carrier removing belt 600 was used in a color copying machine similar to that of Example 1 except for the bias voltage. Toner concentration was 28.0 percent after the carrier liquid removing process. It is believed that the carrier liquid is selectively and effectively removed from the liquid developer. Offset of the toner particles onto the surface of the carrier liquid removing belt 600 was not observed visually. The copying process was conducted by using original test pattern. The resulting image on the paper had the fine image resolution expected from liquid development and no image blur. The relationship between the characteristics of the liquid developer removing apparatus 6 and the evaluation of the resulted images are indicated in Table 1.

EXAMPLE 5

The same color copying apparatus used for Example 4 is used in this example, except that a polyvinylidenefluoride (PVDF) resin having 25 mJ/$m^2$ surface energy is used as the outermost layer 603 of carrier liquid removing belt 600. Surface layer 603 is formed by spraying polyvinylidenefluoride (PVDF) liquid thereon and drying the layer at room temperature on the conductive polyurethane foam layer 602. The average diameter of the apertures of the resulting surface layer were estimated to be about 10 μm and the thickness was about 15 μm.

The toner concentration was 30.0 percent after the carrier liquid removing process. It was understood that the carrier liquid was selectively and effectively removed from the liquid developer. Also, offset of toner particles onto the surface of liquid absorbing belt 600 was not observed visually. The copying process was conducted by using original test pattern. The resulting image on the paper had the fine image resolution expected with liquid developing with no image blur. The relationship between the characteristics of the carrier liquid removing apparatus 6 and the evaluation of the resulted images are indicated in Table 1.

Figure 5:
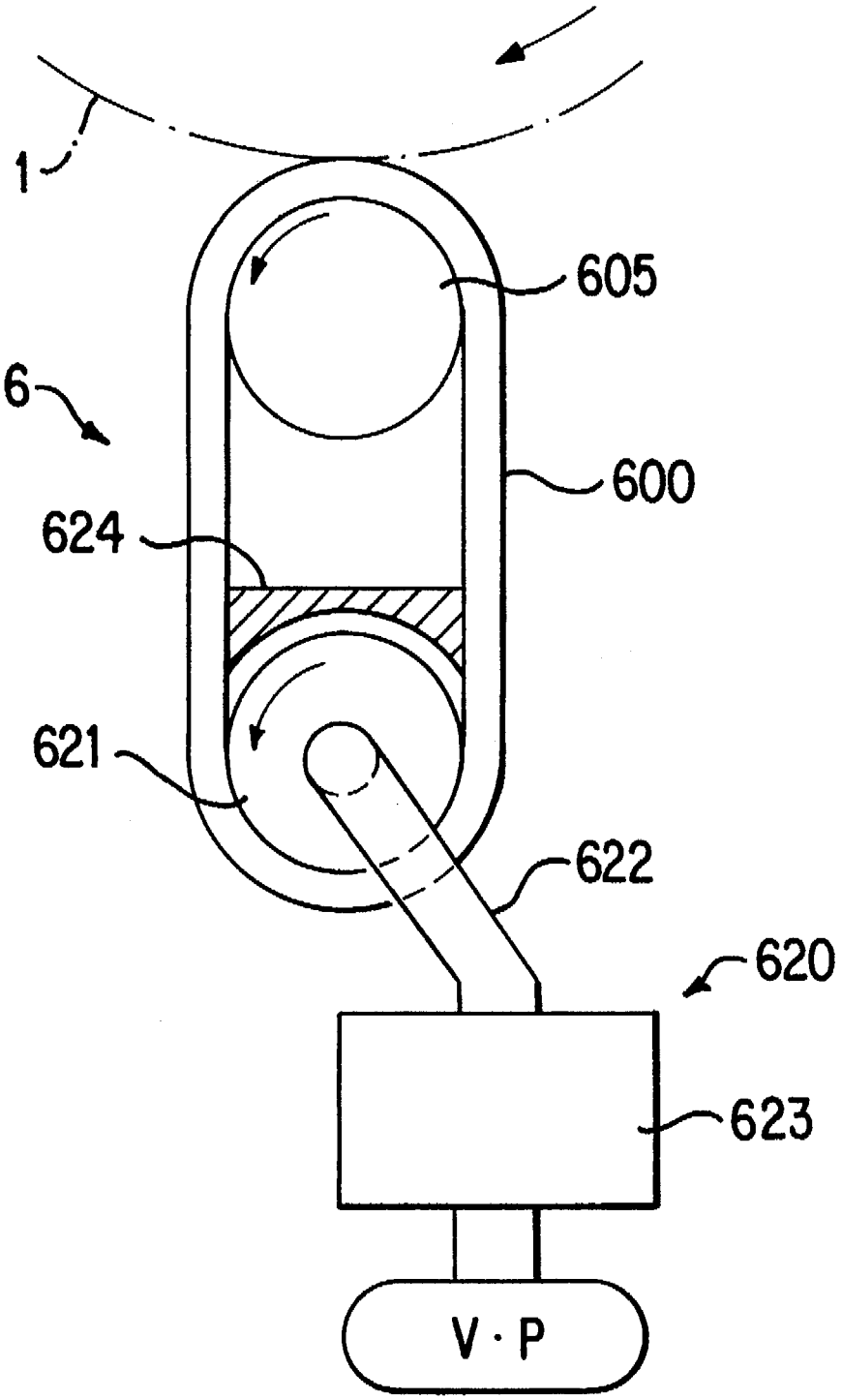
FIG. 5 is a schematic representation of one embodiment of the carrier squeezing roller of present invention.

When absorbing belt 600 is utilized as the carrier liquid removing member, the vacuum-type liquid squeezing apparatus 620 disclosed in FIG. 5 can be used, instead of the press-type liquid squeezing apparatus 610 disclosed in FIG. 3. The vacuum-type liquid removing apparatus comprises a perforated sleeve 621 positioned to press the carrier liquid removing belt 600 from the inner surface of belt 600, in an area where the surface of the photoconductive drum 1 does not contact to the surface of the belt 600. Additional elements include suction pipe 622 coupled to a hollow portion of sleeve 621, the suction tank 623 coupled to the suction pipe, and vacuum pump VP. Because absorbed liquid developer in the belt 600 is drawn from the inner portion of the sleeve 621, an air permeable substance is used as the base 601 of the absorbing belt 600. Portions of the outer surface of the perforated sleeve other than the portion where the perforated sleeve 621 is not in contact with absorbing belt 600 are covered with a non air permeable member 624 to enhance suction efficiency.

One or both of the supporting roller 606 or the squeezing roller 611 of the carrier liquid removing apparatus 610, indicated in FIG. 3, may be formed as the spiral-shaped roller 632 as indicated in FIG. 6. Spiral-shaped roller 632 comprises of the base member 630 and spiral-shaped contact portion 631 formed on the roller base 630. When using this spiral-shaped roller, the excess carrier liquid absorbed in the carrier removing belt 600 is squeezed by the spiral-shaped contact portion 631 and transported along with the proceeding direction of the spiral. The spiral-shaped contact portion 631 contacts the inner or outer surface of the liquid absorbing belt 600 continuously, changing its contact point continuously, by the rotation of the spiral shaped squeezing roller 632.

When spiral-shaped roller 632 is used for the liquid absorbing apparatus, scraping blade 612 indicated in FIG. 3 is not always necessarily, because the squeezed carrier liquid is automatically expelled to the retrieving tank 613 by the function of the spiral-shaped roller 632 itself.

As indicated in FIG. 7, carrier liquid removing apparatus 6 may comprise squeezing roller 611, a pair of supporting rollers 605*a* and 605*b* positioned facing to the surface of the photoconductive drum 1, supporting roller 606 positioned adjacent to the pressure roller 611, carrier liquid removing belt 600 extended between the rollers 605*a*, 605*b* and 606, and liquid retrieving tank 610. In this apparatus, the excess carrier liquid can be removed more efficiently because the area of contact between the carrier liquid removing belt 600 and the surface of the photoconductive drum 1 is enlarged.

Also, as indicated in FIG. 8, the carrier liquid removing belt 600 may be in contact with both the intermediate transfer medium 100 and the photoconductive drum 1, simultaneously.

The color copying machine indicated in FIG. 8 comprises four photoconductive drums 1 (each labeled for Y, M, C, K color reproduction, respectively) positioned along the intermediate transfer belt 100, and image forming apparatus corresponding to each photoconductive drum. Each toner image formed on photoconductive drum is temporarily transferred onto the surface of intermediate transfer belt 100, and then the transferred toner images are retransferred onto the surface of the recording paper 10. In FIG. 8, numeral 101 indicates a charge erase system, numeral 102 indicates a cleaner and numeral 103 indicates a excess carrier liquid removing apparatus corresponding to each photoconductive drum.

The excess carrier liquid removing apparatus 6 is located at an end of the intermediate transfer belt 100 adjacent to the photoconductive drum 1K (a position just after the transfer station 7). The carrier liquid removing belt 600 is mounted so that belt 600 contacts both the surface of the photoconductive drum 1K and the surface of the intermediate belt 100. Thus, carrier removing belt 600 absorbs the excess carrier liquid from the surface of the photoconductive drum 1K and the intermediate belt 100 simultaneously. One of the aforementioned vacuum-type or pressure-type liquid squeezing apparatus is installed to squeeze the removed liquid developer for carrier liquid removing belt 600. The carrier liquid removing apparatus 6 disclosed in Example 1 may be installed at a downstream position of the toner image transfer station for each photoconductive drums (Y, M, C), and independently operated in order to remove excess liquid remaining on the surface of each photoconductive drum.

Figure 9:
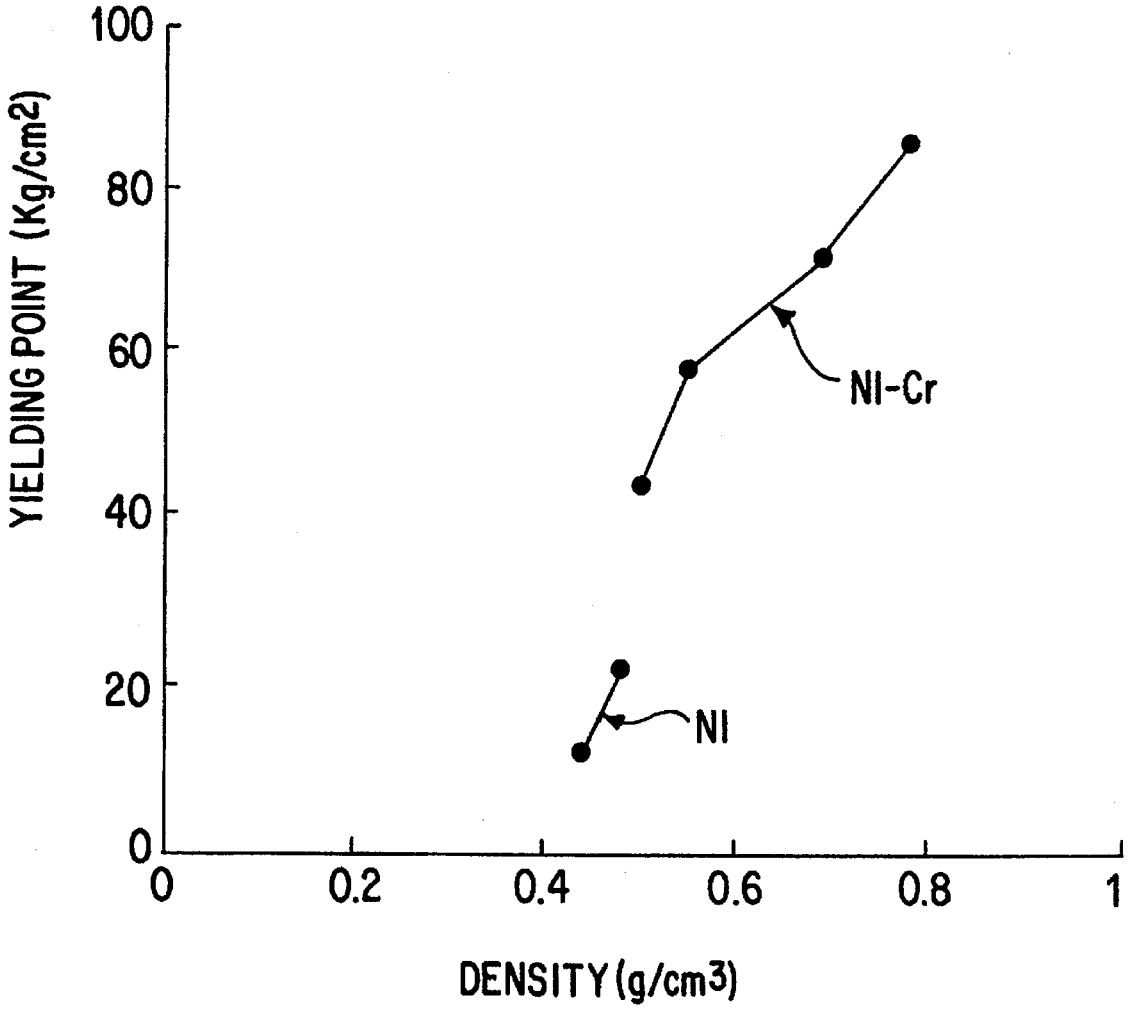
FIG. 9 is a graph showing the relationship between the values of yielding point and the values of density of two different kind metal materials.

In Example 1, a Nickel-Chrome metal alloy is disclosed for the perforated metal sheet for the sleeve member 61 of carrier liquid removing roller 60. As indicated in FIG. 9, the Nickel-Chrome alloy sheet generally indicates higher strength compare to the Nickel in terms of the characteristic of the yielding point. It is believed that a sleeve 60 utilizing the Nickel-Chrome sheet would have a higher strength than that of the Ni sheet.

Figure 10:
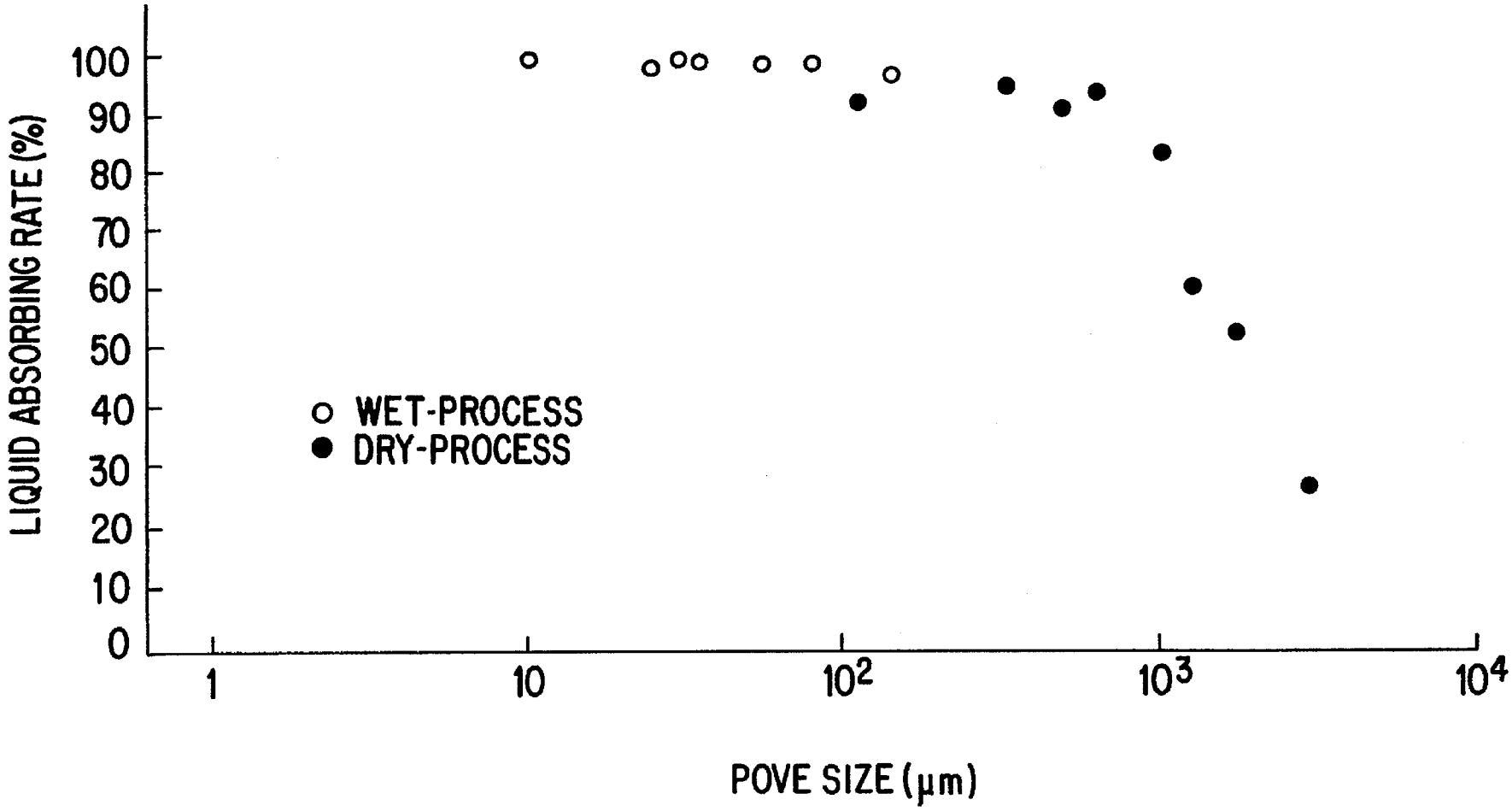
FIG. 10 is a graph showing the relationship between the values of aperture diameter and the values of liquid absorbing rate of two different kind polyurethanefoam material.
Figure 11:
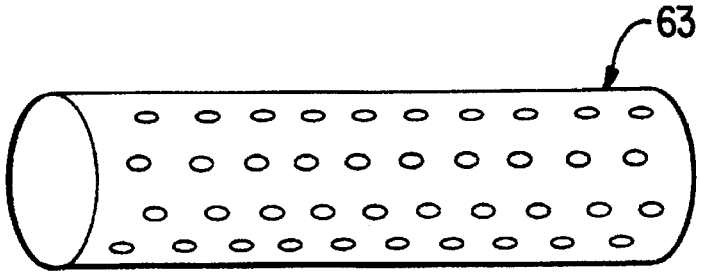
Figure 12:
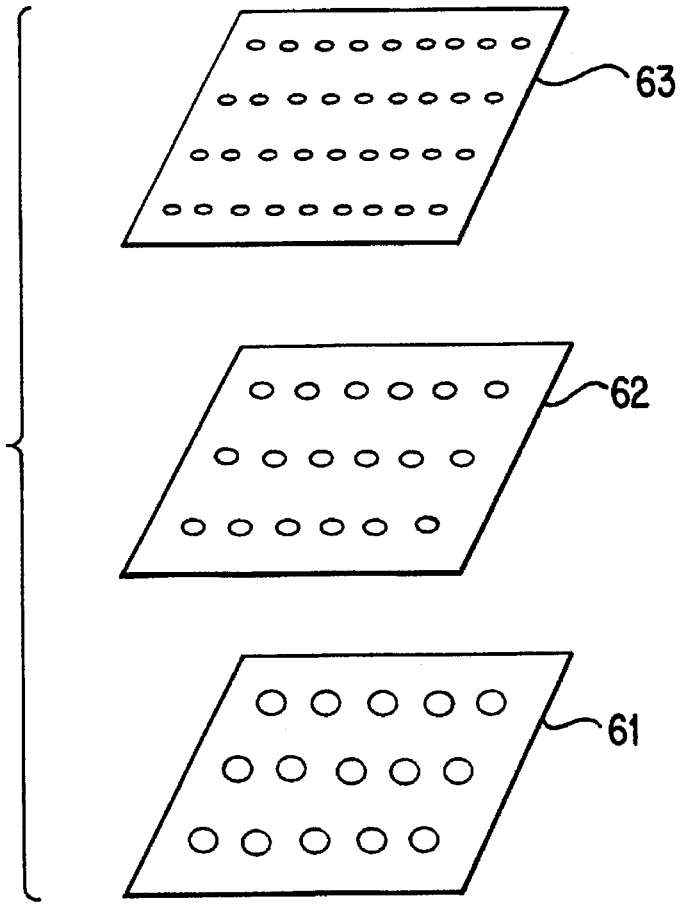

The wet-type polyurethane foam layers 62 and 602 of carrier liquid removing roller 60 made by wet-process have been previously disclosed. As indicated in FIG. 10, the wet-type polyurethane foam layer has smaller apertures and higher liquid absorbing capability compared to the dry-type polyurethane foam layer. The liquid absorbed percentages indicated in FIG. 10 were estimated by using a 2 mm thick polyurethane foam contacting 100 mg of isoper liquid, tradename of Exxon corp., under the 70 g/cm$^2$ contacting pressure. The amount of absorbed liquid was measured and calculated as percentage to the whole amount of the isoper liquid.

While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

TABLE 1

| | Surface layer | | | Elastic perforated member | | Substrate | | Evaluation | | |
|---|---|---|---|---|---|---|---|---|---|---|
| | Surface energy (mJ/m2) | Pore size (μm) | Material | Pore size (μm) | Material | Pore size (μm) | Material | Toner offset | Toner conc. (%) | Image Quality |
| Example 1 | 18.5 | 10 | PTFE | 30 | Polyurethane (wet-process) | 30 | Ni—Cr alloy | None | 37 | High Quality |
| Example 2 | 20.0 | 20 | PEF | 30 | Polyurethane (wet-process) | 150 | Ni—Cr alloy | None | 35 | High Quality |
| Example 3 | 25.0 | 10 | PVDF | 30 | Polyurethane (wet-process) | 150 | Ni—Cr alloy | Occured Slightly | 35 | Good |
| Example 4 | 18.5 | 10 | PTFE | 30 | Polyurethane (wet-process) | — | PET Film | None | 28 | High Quality |
| Example 5 | 25 | 10 | PVDF | 30 | Polyurethane (wet-process) | — | PET Film | None | 30 | Good |
| Comp. Example 1 | 31 | 15 | PE | 30 | Polyurethane (wet-process) | 150 | Ni—Cr alloy | Occured Significantly Unremovable | 33 | Bad |
| Reference | — | — | — | — | — | — | — | — | 15 | Image Blurred |

I claim:

1. A liquid removing device for removing carrier liquid from an image carrying member on which a toner image containing toner particles is formed, comprising:

a base member;

an elastic perforated material formed on the base member having a continuous porosity sufficient to absorb excess liquid therein; and an outermost layer formed on the elastic perforated material which has a low surface energy sufficient to prevent offset of the toner image and defining apertures which allow substantial passage of the carrier liquid to the elastic perforated material, while blocking passage of toner particles thereto.

2. The liquid removing device as defined in claim 1, wherein the apertures defined by the outermost layer have a sufficient diameter to enhance a capillary force at the outermost layer to absorb carrier liquid in contact therewith.

3. The liquid removing device as defined in claim 1, wherein the apertures defined by the outermost layer have an average diameter substantially smaller than that of the toner particles.

4. The liquid removing device as defined in claim 1, wherein the base member is a shaft.

5. The liquid removing device as defined in claim 1, wherein the base member is an endless belt.

6. The liquid removing device as defined in claim 1, wherein the liquid removing device further comprises a bias voltage source coupled to the base member.

7. The liquid removing device as defined in claim 6, wherein the bias voltage applied to a shaft cause an electric field at the outermost layer to prevent transferring the toner particle from the image carrying member thereto.

8. The liquid removing device as defined in claim 7, wherein the base member is a conductive material and the bias voltage source is electrically connected to the base member.

9. The liquid removing device as defined in claim 6, wherein the elastic perforated material is a conductive material.

10. The liquid removing device as defined in claim 1, wherein the outermost layer is seamless.

11. The liquid removing device as defined in claim 1, wherein the outermost layer has a surface energy not more than 25 $mJ/m^2$ and the small apertures defined thereby have an average diameter from 1 to 10 μm.

12. The liquid removing device as defined in claim 11, wherein the outermost layer has a surface energy from 6 $mJ/m^2$ to 25 $mJ/m^2$.

13. The liquid removing device as defined in claim 1, wherein the base member is perforated and including a vacuum source coupled to the base member to vacuum the carrier liquid through the base member and the vacuum source to a sump.

14. The liquid removing device as defined in claim 13, wherein the base member, the elastic perforated material and the outermost layer have openings with first, second, third average diameters where the first diameter is greater than the second diameter, and the second diameter is greater than the third diameter.

15. The liquid removing device as defined in claim 13, and further comprising a squeezing member contacting the outermost layer to squeeze the carrier liquid from the elastic perforated material through the outermost layer to a sump.

16. The liquid removing device as defined in claim 1, and further comprising a squeezing member contacting the outermost layer to squeeze the carrier liquid from the elastic perforated material through the outermost layer to a sump.

17. The liquid removing device as defined in claim 16, wherein the squeezing member defines a continuous spiral bar so as to enhance squeezing efficiency and to transport the carrier liquid in a selected direction defined by the spiral.

18. The liquid removing device as defined in claim 1, wherein the image carrying member comprises a photoreceptor on which latent images are formed and developed.

19. The liquid removing device as defined in claim 18, wherein the image carrying member comprises an intermediate belt carrying toner images.

20. The image reproducing apparatus comprising:

an image carrying member;

a toner image forming system for forming a toner image containing toner particles on the surface of the image carrying member; and a liquid removing device for removing carrier liquid from the image carrying member which comprises a base member, an elastic perforated material formed on the base member having a continuous porosity sufficient to absorb excess liquid therein, and an outermost layer formed on the elastic perforated material which has a low surface energy sufficient to prevent offset of the toner image and defining apertures which allow substantial passage of the carrier liquid to the elastic perforated material, while blocking passage of toner particles thereto.

* * * * *